US009840822B2

(12) United States Patent
Foster

(10) Patent No.: US 9,840,822 B2
(45) Date of Patent: Dec. 12, 2017

(54) DRAIN ASSISTING WATER FIXTURE

(71) Applicant: Kevin Jason Foster, Armstrong (CA)

(72) Inventor: Kevin Jason Foster, Armstrong (CA)

( * ) Notice: Subject to any disclaimer, the term of this patent is extended or adjusted under 35 U.S.C. 154(b) by 0 days.

(21) Appl. No.: 14/832,662

(22) Filed: Aug. 21, 2015

(65) Prior Publication Data

US 2017/0051465 A1 Feb. 23, 2017

(51) Int. Cl.
*E02B 13/00* (2006.01)
*E02B 11/00* (2006.01)
*E02B 3/02* (2006.01)

(52) U.S. Cl.
CPC ..... *E02B 11/005* (2013.01)

(58) Field of Classification Search
CPC ..... E02B 11/00; E02B 11/005; E02B 13/00; E02B 3/00; E02B 3/02; E03F 1/00; E03F 1/001; F04F 5/00; F04F 5/02; F04F 5/10; F04F 5/44; F04F 5/46; F04F 5/54
USPC ..... 405/36, 39, 40, 41, 80, 127
See application file for complete search history.

(56) References Cited

U.S. PATENT DOCUMENTS 2,482,260 A 9/1949 Goddard
3,129,874 A 4/1964 Mittelstaedt
3,829,247 A 8/1974 Edmonson
4,941,217 A 7/1990 Tobias et al.
4,963,073 A 10/1990 Tash et al.
5,160,216 A * 11/1992 Takada ..... E02B 3/00 137/386
6,146,105 A 11/2000 Williams
6,817,120 B2 11/2004 Tsuchiya et al.
6,848,681 B2 * 2/2005 Washington ..... B63J 2/08 261/116
7,111,975 B2 * 9/2006 Fenton ..... F04F 5/24 137/889
7,347,646 B2 * 3/2008 Legge ..... E02D 31/004 405/129.45
7,789,633 B2 9/2010 Tash
2006/0092758 A1 * 5/2006 Ellmers ..... B01F 5/0426 366/163.2
2008/0044294 A1 2/2008 Dawson et al.
2009/0252276 A1 * 10/2009 Ishida ..... F04F 5/464 376/361

(Continued)

FOREIGN PATENT DOCUMENTS

DE 19927608 A1 * 12/2000 ..... C02F 3/1294
DE 10016924 A1 * 7/2001 ..... F04F 5/42
WO WO 2013154222 A1 * 10/2013 ..... F04F 5/46

*Primary Examiner* — Benjamin Fiorello
*Assistant Examiner* — Stacy Warren
(74) *Attorney, Agent, or Firm* — Richard D. Okimaw

(57) ABSTRACT

An apparatus and system for drawing water from a water source into a flowing water body comprises a tubular member defined by a sidewall extending between an inlet and an outlet and a central passage therethrough and a drainage pipe having an internal passage therethrough. The drainage pipe passes through the sidewall of the tubular member and has an outlet located within the central passage. The drainage outlet is oriented in a direction towards the outlet of the tubular member and has an unobstructed continuous profile extending there through. The apparatus further comprises a frame adapted to support the tubular member within a body of flowing water at a height above a bottom of the body of flowing water below a top surface of the flowing water.

6 Claims, 5 Drawing Sheets

(56) References Cited

U.S. PATENT DOCUMENTS

2011/0109089 A1* 5/2011 Frye ..... F03B 13/08
290/54

* cited by examiner

DRAIN ASSISTING WATER FIXTURE

BACKGROUND OF THE INVENTION

1. Field of Invention

The present invention relates generally to water drainage systems in general and in particular to a method and apparatus for assisting the drainage of water into a moving water supply.

2. Description of Related Art

Many water sources frequently need to be drained of excess water. In particular fields and other lands may be prone to flooding which adversely affects their utility and usability for such purposes. In such situations, it is necessary to remove the excess water prior to resuming use of these lands. Current methods of removing this water may not be satisfactory in all situations.

In particular, one common method to remove standing water is through the use of a pump either at the proximate or distal end of a pipe or hose to pump the standing water from the undesirable location to a less disadvantageous location such as a lake, river, ditch or the like. Disadvantageously, pumps may not be usable in all situations as such pumps require an electrical or other power source to operate. It will be appreciated that use of such pumps may not be possible in some locations due to the unavailability of such power sources or due to the cost of providing such power source.

Another common method for removing standing water is to provide ditches having a bottom lower than the surface of the standing water. It will be appreciated that such systems may not be appropriate for all locations such as were an adjoining drainage site is available. Additionally, such gravity drain systems may have a limited speed of drainage due to having to rely upon the speed at which the water may drain by gravity operation alone.

SUMMARY OF THE INVENTION

According to a first embodiment of the present invention there is disclosed an apparatus for drawing water from a water source into a flowing water body. The apparatus comprises a tubular member defined by a sidewall extending between an inlet and an outlet and a central passage therethrough and a drainage pipe having an internal passage therethrough. The drainage pipe passes through the sidewall of the tubular member and has an outlet located within the central passage. The drainage outlet is oriented in a direction towards the outlet of the tubular member and has an unobstructed continuous profile extending there through. The apparatus further comprises a frame adapted to support the tubular member within a body of flowing water at a height above a bottom of the body of flowing water below a top surface of the flowing water.

The tubular member may include a narrowed portion in a middle portion thereof between the inlet and outlet. The narrowed portion may form a venturi. The drainage outlet may be located within the venture.

The drainage pipe may extend from the drainage outlet in a direction from outlet to the inlet of the tubular body. The drainage pipe may extend through the sidewall of the tubular body at an angle relative thereto.

The inlet of the tubular body may include a flared opening. The outlet of the tubular body may include a flared outlet.

According to a further embodiment of the present invention there is disclosed an apparatus for drawing water from a water source into a flowing water body. The apparatus comprises a tubular member defined by a sidewall extending between an inlet and an outlet and a central passage therethrough and a drainage pipe having an internal passage therethrough. The drainage pipe passes through the sidewall of the tubular member and has an outlet located within the central passage. The drainage outlet is oriented in a direction towards the outlet of the tubular member and has a continuous diameter with the internal passage of the drainage pipe. The apparatus further comprises a frame adapted to support the tubular member within a body of flowing water at a height above a bottom of the body of flowing water below a top surface of the flowing water and a pipe extending from said drainage pipe to a water source to be drained.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
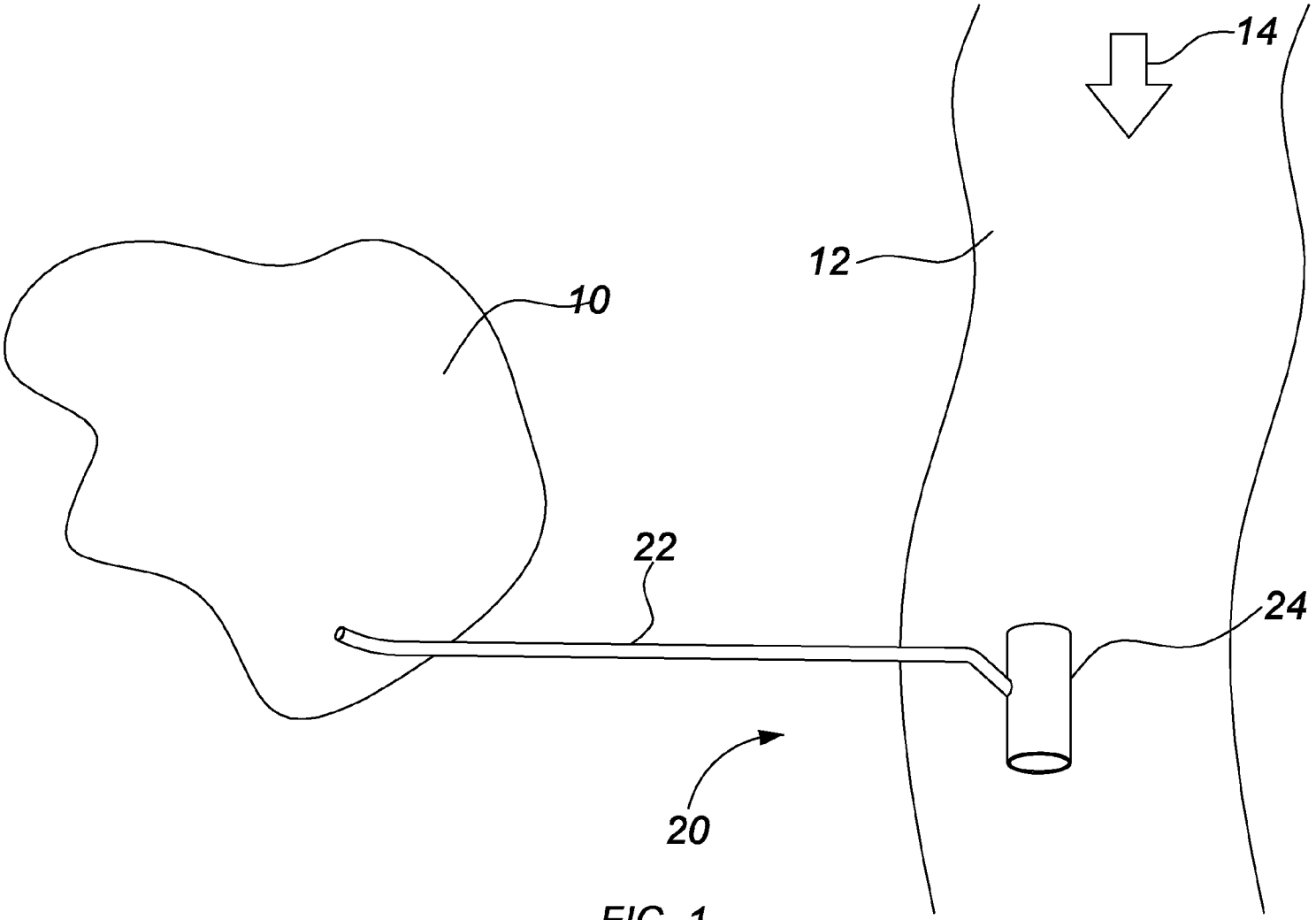
FIG. 1 is a plan view of a system for use in draining a water supply according to a first embodiment of the present invention.

Referring to FIG. 1, a system for drawing water out of an undesired standing source 10 such as, by way of non-limiting example, a flooded area of land, into a flowing water source 12, such as, by way of non-limiting example, a river or creek is illustrated generally at 20. The system comprises a drain pipe 22 extending from the standing water 10 to the flowing water source 12 and a drain assisting device 24 as will be more fully described below located at the distal end of the drain pipe 22 within the flowing water source 12. The drain assisting device utilizes the flow of water within the flowing water source 12 to pull or draw the water through the drain pipe to drain the standing water 10 faster.

Figure 2:
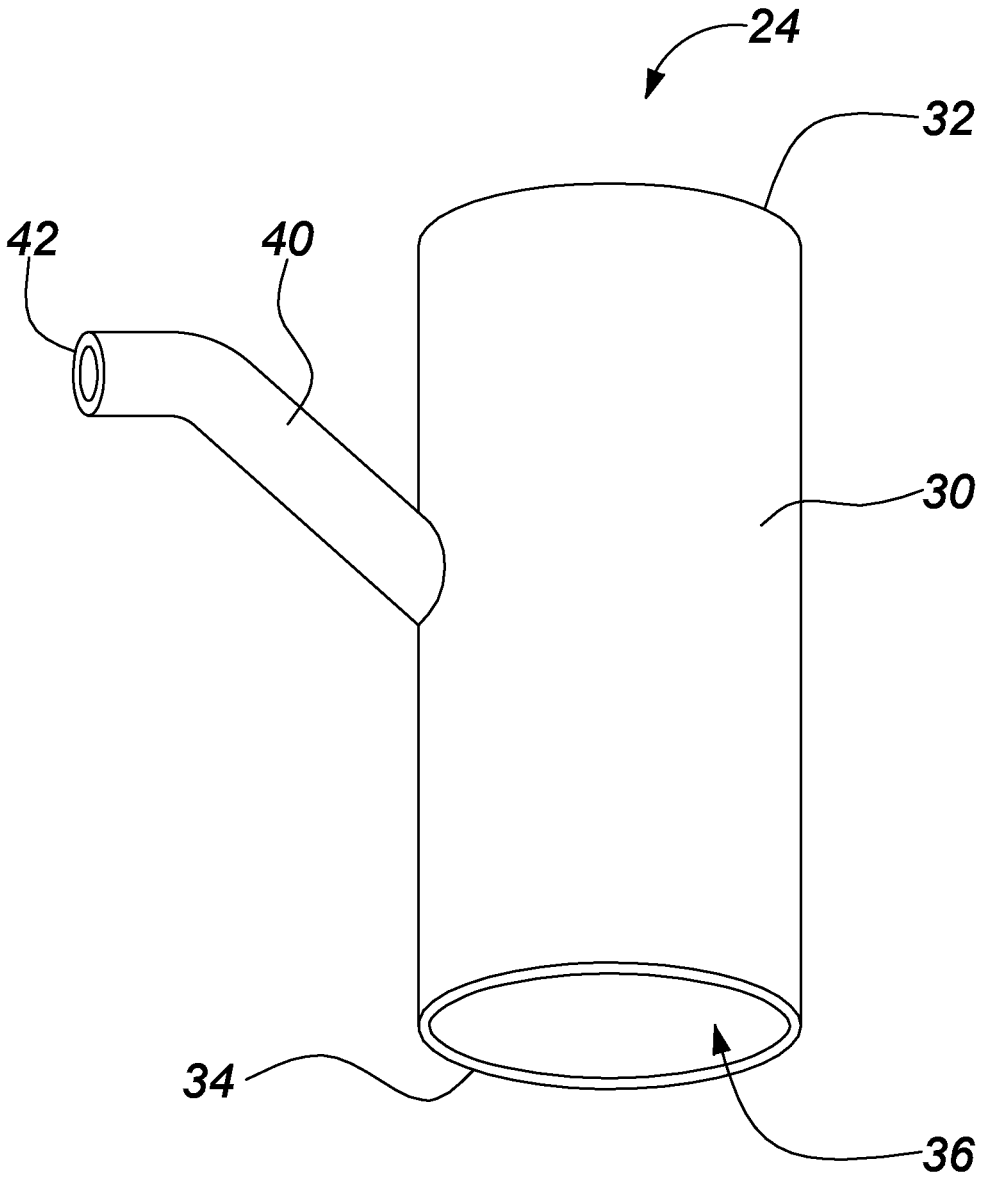
FIG. 2 is a perspective view of an apparatus for assisting drainage of standing water or use in the system of FIG. 1 according to a first embodiment of the present invention.
Figure 3:
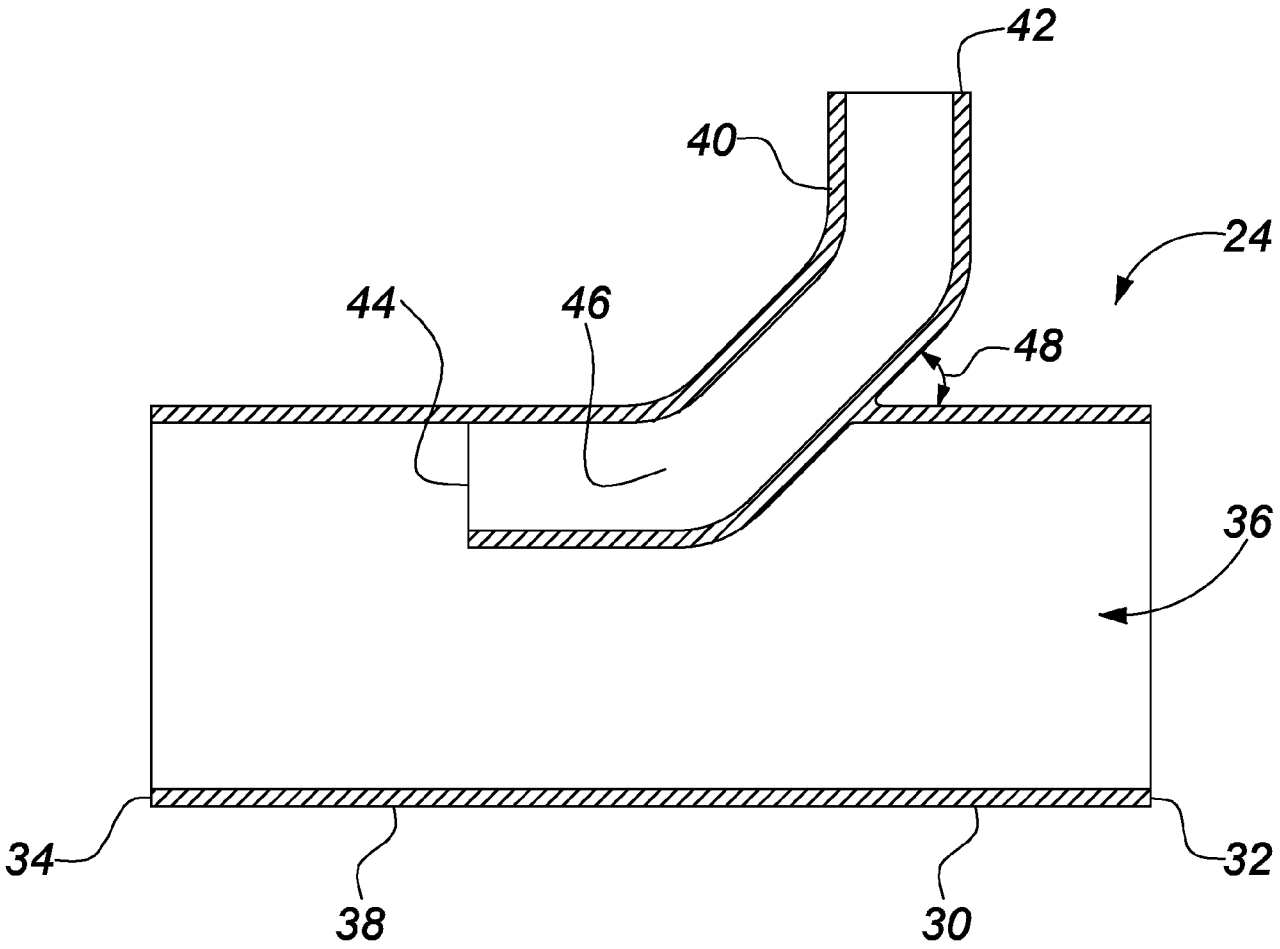
FIG. 3 is a cross sectional view of the apparatus of FIG. 2 as taken along the line 3-3.

With reference to FIGS. 2 and 3, the drain assisting device 24 comprises a tubular member 30 extending between inlet and outlet ends, 32 and 34, respectively. The tubular member 30 further includes a central passage 36 therethrough extending between the inlet and outlets 32 and 34 defined by a sidewall 38 of the tubular member. As illustrated in FIG. 3, the central passage 36 may have a continuous diameter between the inlet and outlet ends 32 and 34. It will be appreciated that the diameter of the central passage may be selected to provide sufficient water flow therethrough. In particular, the diameter of the central passage may be selected to correspond to the diameter of the drain pipe 22 with which it is used as will be more fully described below. By way of non-limiting example, the central passage may have a diameter of between 6 and 12 inches (152 and 305 mm) for use with a drain pipe having a diameter between 6 to 8 inches (152 and 203 mm). The tubular member 30 also has a length between the inlet and outlets ends 32 and 34 selected to provide sufficiently consistent and controlled water flow therethrough. By way of non-limiting example, it has been found that a length of between 60 and 16 inches has been useful for a central passage having a diameter of between 6 and 12 inches (152 and 305 mm).

The drain assisting device 24 further includes a drain inlet pipe 40 passing through the sidewall 38 of the tubular member 30. The drain pipe extends from an inlet end 42 located outside of the central passage 36 of the tubular member 30 to an outlet end 44 located within the central passage of the tubular member. The drain inlet pipe 40 includes a central passage 46 therethrough which has an unobstructed profile therethrough. In particular, the outlet end 44 does not include a nozzle or other flow restricting means in the outlet end so as to not reduce the flow of water therethrough. The drain inlet pipe 40 may have a reduced dimension upstream of the outlet end 44 so as to facilitate location within the central passage 36 however it will be appreciated that such reduced profile will be continuous through to the outlet end 44 thereafter. In particular it has been found that a reduced diameter of 3 to 4 inches (76 to 102 mm) for a portion of the drain inlet pipe 40 has been useful for use with a 6 inch (152 mm) drain inlet pipe. The inlet end 42 may be connected to a drain pipe 22 through any conventional means such as threading, pipe welding, connectors or the like. The outlet end is oriented towards the outlet end 34 of the tubular member 30 with the drain inlet pipe extending upstream therefrom towards the inlet end 32 of the tubular member. As illustrated in FIG. 3, the drain inlet pipe 40 may pass through the sidewall 38 of the tubular member at an angle 48 relative thereto. The angle may be selected to be between 30 and 90 degrees although it will be appreciated that other angles may also be utilized.

Figure 5:
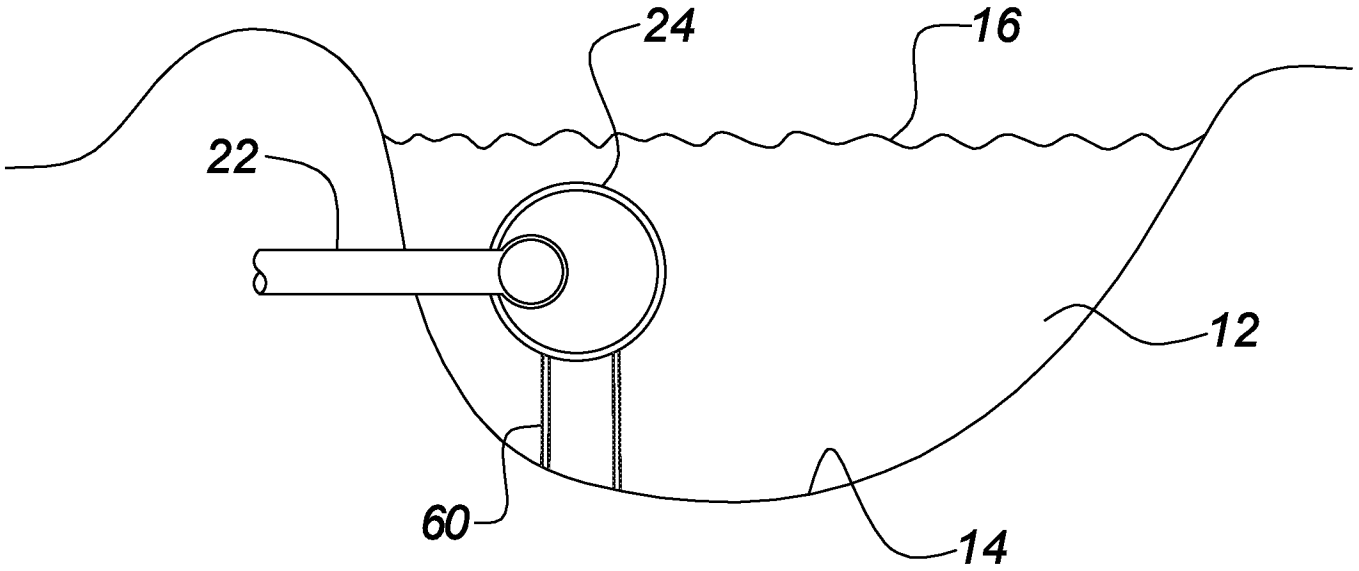
FIG. 5 is a cross sectional view of the apparatus of FIG. 2 as located within a flowing water source.

In operation, the drain assisting device 24 may be connected to a drain pipe 22 extending to a standing water source wishing to be drained and thereafter the drain assisting device 24 located within a flowing water source 12 below the water level as illustrated in FIG. 5. As the water flowing through the water source passes through the tubular member, such water flow will draw the water to be drained out of the outlet end 44 so as to induce a greater flow rate through the drain pipe 22. As illustrated in FIG. 5, a frame 60 may be located below the tubular member 30 so as to position the central passage 36 of the tubular member 30 at a height above the bottom 14 of the flowing water source 12 while remaining below the surface thereof 16 thereby ensuring adequate water flow therethrough. The drain pipe 22 may then pass through the side bank of the flowing water source 12 as illustrated in FIG. 5 or over the bank.

Figure 4:
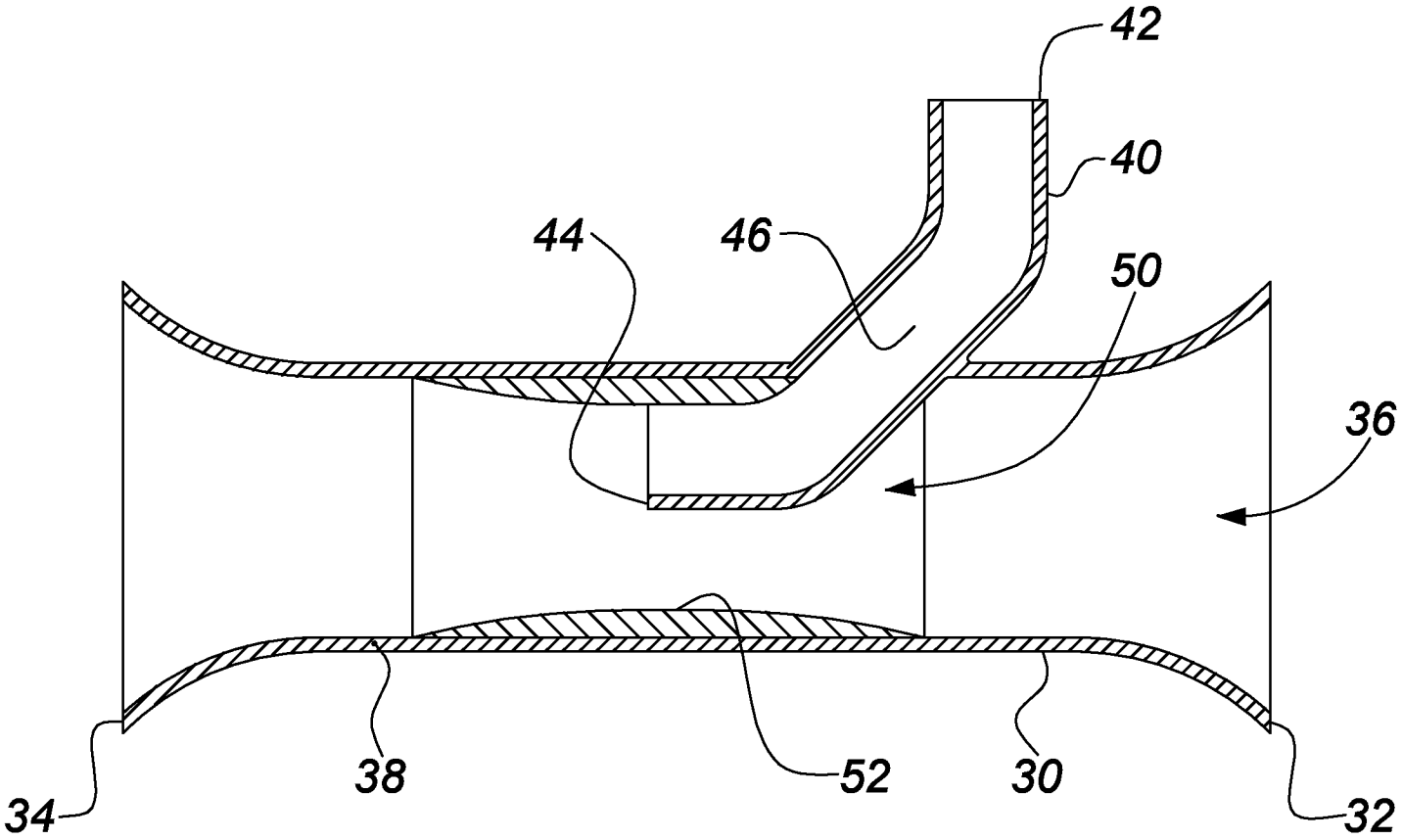
FIG. 4 is a cross sectional view of the apparatus of FIG. 2 as taken along the line 3-3 according to a further embodiment of the present invention.

Turning to FIG. 4, according to an optional embodiment, one or both of the inlet and outlet ends 32 and 34 of the tubular member may be flared to increase or enhance water flow therethrough. Optionally, the central passage 36 may include a throat section 50 which may be either co-formed with the tubular member 30 or through providing an insert 52 therein so as to narrow the central passage 36 at the middle portion of the device proximate to the outlet end 44 of the drain inlet pipe 40.

While specific embodiments of the invention have been described and illustrated, such embodiments should be considered illustrative of the invention only and not as limiting the invention as construed in accordance with the accompanying claims.

What is claimed is:

1. An apparatus for drawing water from a water source into a flowing water body, the apparatus comprising:

a tubular member defined by a sidewall extending between an inlet and an outlet and a central passage therethrough;

a drainage inlet pipe having an internal passage therethrough, said drainage inlet pipe passing through said sidewall of said tubular member and having a drainage outlet located within said central passage, said drainage outlet of drainage inlet pipe being oriented in a direction towards said outlet of said tubular member;

a drain pipe extending from a drainage inlet within a remote free standing liquid reservoir to said drainage inlet pipe; and a frame adapted to support said tubular member within a body of flowing water at a height above a bottom of said body of flowing water and below a top surface of said flowing water;

wherein said central passage is unobstructed other than by said drainage inlet pipe and wherein water is non-mechanically drawn from said remote free standing liquid reservoir through said drain pipe and said drainage inlet pipe by movement of water through said central passage without external assistance.

2. The apparatus of claim 1 wherein said central passage is shaped to form a venturi.

3. The apparatus of claim 2 wherein said drainage outlet is located within said venturi.

4. The apparatus of claim 1 wherein said drainage inlet pipe extends through said sidewall of said tubular member at an angle relative thereto.

5. The apparatus of claim 1 wherein said inlet of said tubular member includes a flared opening.

6. The apparatus of claim 1 wherein said outlet of said tubular member includes a flared outlet.

* * * * *